United States Patent [19]

Kopp

[11] Patent Number: 4,587,794

[45] Date of Patent: May 13, 1986

[54] APPARATUS FOR FORMING A SINGLE-FIN WRAPPER SLEEVE

[75] Inventor: Georg Kopp, Uhwiesen, Switzerland

[73] Assignee: SIG Schweizerische Industrie-Gesellschaft, Neuhausen am Rheinfall, Switzerland

[21] Appl. No.: 589,439

[22] Filed: Mar. 14, 1984

[30] Foreign Application Priority Data

Mar. 14, 1983 [CH] Switzerland ..... 1392/83

[51] Int. Cl.[4] ..... B65B 9/22

[52] U.S. Cl. ..... 53/550; 493/248

[58] Field of Search ..... 53/450, 550, 545; 493/248, 302, 303, 304, 439, 440

[56] References Cited

U.S. PATENT DOCUMENTS

| | | | |
|---|---|---|---|
| 2,741,956 | 4/1956 | Diffenbaugh | 493/248 |
| 3,544,340 | 12/1970 | Miller et al. | 53/450 |
| 3,581,457 | 6/1971 | Gerlach et al. | 53/550 |
| 4,464,883 | 8/1984 | Glover | 53/550 |

FOREIGN PATENT DOCUMENTS

| | | |
|---|---|---|
| 1179495 | 10/1964 | Fed. Rep. of Germany . |
| 1409922 | 7/1965 | France . |
| 386324 | 4/1965 | Switzerland . |
| 527090 | 10/1972 | Switzerland . |

*Primary Examiner*—Horace M. Culver

*Attorney, Agent, or Firm*—Spencer & Frank

[57] ABSTRACT

An apparatus for forming a single-fin wrapper sleeve about articles advanced through the apparatus, comprises a conveyor for advancing the articles in a conveying direction and in a plane of conveyance and a shaping body having a vertical longitudinal halving plane extending parallel to the conveying direction and perpendicularly to the plane of conveyance. The shaping body includes a first main forming surface including a planar surface portion and a second main forming surface joining the first main forming surface downstream as viewed in the conveying direction. The second main forming surface has a gradually closing tubular shape surrounding the conveyor and a longitudinal slot extending underneath the plane of conveyance parallel to the conveying direction and symmetrically with respect to the halving plane.

8 Claims, 8 Drawing Figures

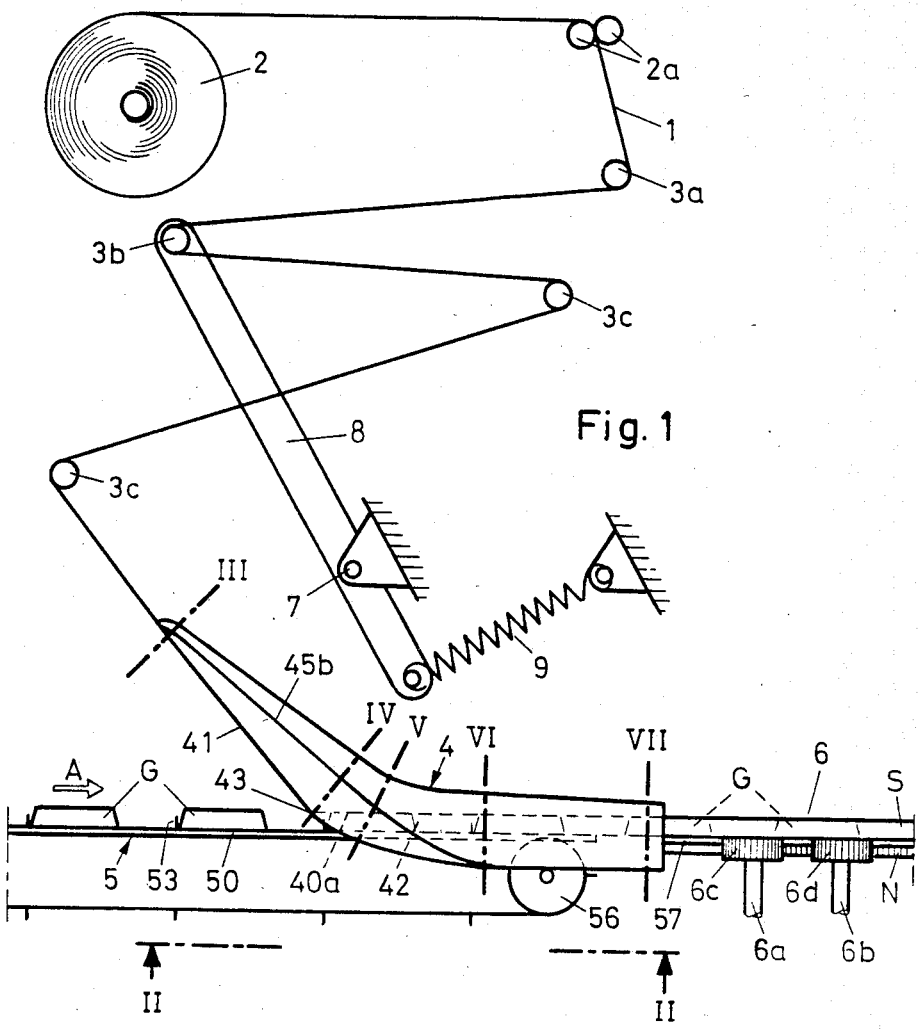
Fig. 1
Fig. 2
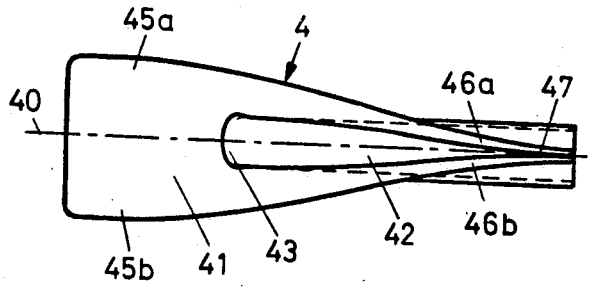
Fig. 8
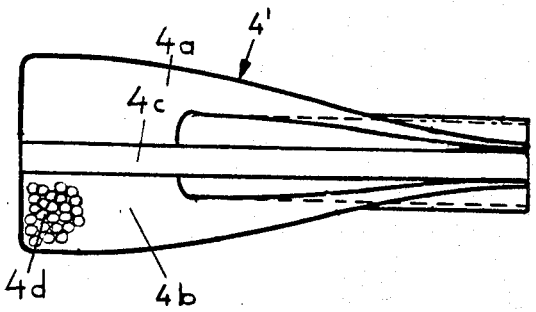

APPARATUS FOR FORMING A SINGLE-FIN WRAPPER SLEEVE

BACKGROUND OF THE INVENTION

This invention relates to a shaping apparatus for forming a single-fin sleeve from a wrapper sheet, particularly from a non-laminated aluminum foil in a packing machine for packaging articles, particularly confectionary items. The articles are continuously supplied to a conveying device by which they are advanced in a spaced relationship to one another.

Swiss Pat. No. 386,324 discloses a folding device for making a single-fin wrapper sleeve from a packaging sheet drawn from a supply roll. For making the side walls of the sleeve there are provided a guiding fork and a folding plate of U-shaped cross section. Both the guiding fork and the folding plate are supported on a carrier and are adjustable on all sides. Folding tongues with upwardly oriented guide horns are provided for forming the bottom surface of the sleeve. A folding device of this type is adapted to process relatively thick packing materials without difficulty. Currently used foils having a thickness of 1/100 mm, particularly non-laminated thermo-lacquered aluminum foils, however, have a tendency to buckle and tear if handled with such a folding apparatus.

An improvement in a folding apparatus of the above type is achieved by means of a forming (shaping) shoulder as disclosed, for example, in German Pat. No. 1,179,495. For making the forming shoulder a mandrel is surrounded by an externally tacky envelope which, in turn, is surrounded by a flexible foil such that one end of the foil is shaped to form a sleeve whereas the other end is of planar configuration. Thus, the shape of the foil is a sheet which runs together and then forms a sleeve. Then, the pocket formed by the foil is filled with a mass that hardens without shrinkage and after hardening of the mass the foil and the envelope are removed. The resulting body constitutes the desired shaping shoulder.

A very delicate packaging material such as the above-noted aluminum foil, however, places the most stringent requirements on packaging machines, such as a uniform and jar-free delivery speed, a gentle run-on as well as an accurate and sensitive regulation of the tensioning force. In addition, the forming device must have an optimal shape for making the sleeve, and there should be provided a removal transport device which can be synchronized with high accuracy with the run-on speed. Such packaging materials are used at the present time, for example, for wrapping chocolate bars. Thus, for reason of hygiene alone it is indispensable that the packaging material be free from torn portions.

SUMMARY OF THE INVENTION

It is an object of the invention to provide an improved forming device of the above-outlined type which meets the discussed requirements.

This object and others to become apparent as the specification progresses, are accomplished by the invention, according to which, briefly stated, the apparatus for forming a single-fin wrapper sleeve about articles advanced through the apparatus, comprises a conveyor for advancing the articles in a conveying direction and in a plane of conveyance and a shaping body having a vertical longitudinal halving plane extending parallel to the conveying direction and perpendicularly to the plane of conveyance. The shaping body includes a first main forming surface including a planar surface portion and a second main forming surface joining the first main forming surface downstream as viewed in the conveying direction. The second main forming surface has a gradually closing tubular shape surrounding the conveyor and a longitudinal slot extending underneath the plane of conveyance parallel to the conveying direction and symmetrically with respect to the halving plane.

BRIEF DESCRIPTION OF THE DRAWINGS

FIG. 1 is a schematic side elevational view of a preferred embodiment of the invention.

FIG. 2 is a bottom plan view taken in the direction of arrows II of FIG. 1.

FIG. 8 is a bottom plan view, similar to FIG. 2, of another preferred embodiment of the invention.

DESCRIPTION OF THE PREFERRED EMBODIMENT

Figure 3:
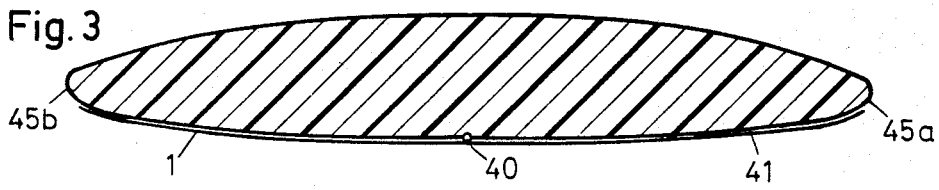
FIG. 3 is a sectional view taken along line III of FIG. 1.

In a packing machine, a part of which is schematically shown in FIG. 1, an aluminum foil 1 of indefinite length is advanced from a supply roll 2 over deflecting rollers 3*a*, 3*b* and 3*c* to a shaping body 4 which wraps the foil about articles G advanced on a horizontal conveyor 5. Downstream of the shaping body 4 as viewed in the direction of the advance of the articles G there is arranged a sealing station 6 comprising sealing rollers 6*c* and 6*d* each having a respective vertical shaft 6*a* and 6*b* and each cooperating with a respective sealing roller not visible in FIG. 1.

Between the supply roll 2 and the deflecting rollers 3*a*, 3*b*, 3*c* and 3*d* there is arranged a guide roller pair 2*a* which maintains constant the loop angle at the first deflecting roller 3*a*. The second deflecting roller 3*b* is mounted on an end of a two-armed lever 8 pivotally supported by a pin 7 in a stationary bracket. The lever 8 is urged counterclockwise by a spring 9, whereby the aluminum foil 1 is maintained under constant tension. Since such a foil guidance is conventional, it is not illustrated or described in more detail.

Figure 5:
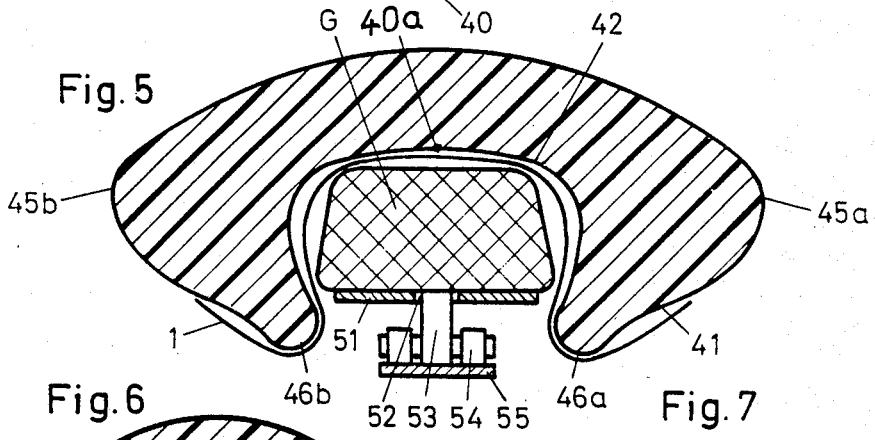
FIG. 5 is a sectional view taken along line V of FIG. 1.
Figure 6:
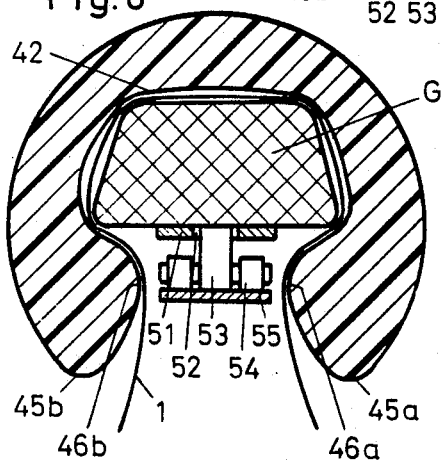
FIG. 6 is a sectional view taken along line VI of FIG. 1.

The conveyor 5 for advancing the articles G is also of conventional structure and may be of the type disclosed in Swiss Pat. No. 527,090. Accordingly, each article G is, on a horizontal, stationary track 50 formed of guide rails 51 advanced in the direction of the arrow A by a pusher 53 projecting upwardly through a central longitudinal slot 52 as shown in FIGS. 5 and 6. The upper face of the guide rails 51 on which the articles G are supported, defines a horizontal plane of conveyance which is thus perpendicular to the plane of FIG. 5. The pushers 53 are rotatably connected with a conveyor chain 54 which is guided on a stationary support plate 55. A conventional cam track arrangement (not shown) provides that the pushers 53 are folded down against the direction of conveyance as they move around the chain deflecting sprocket 56 to ensure that, while doing so, they do not damage the aluminum foil 1 or the articles G.

The guide rails 51, as seen upon a comparison of FIGS. 1, 5, 6 and 7, taper in the direction of conveyance and entirely disappear in the zone in which the lateral parts of the aluminum foil 1 are wrapped around the articles G.

Downstream of the foil shaping body 4 there are provided guide rails 57 which are separated from one another by means of a central longitudinal slot in which the fin N of the package is guided and is subsequently sealed in the sealing station 6. The sealing roller pairs in the sealing station 6, in addition to their sealing function, also serve for advancing the single-fin wrapper sleeve S already charged with the articles G. Downstream of the sealing station 6 there is conventionally arranged a second sealing station to seal portions of the sleeve S between the subsequent articles G and to cut the sleeve S into individual packages.

The purpose of the shaping body 4 is to form a sleeve from the aluminum foil 1 introduced in a planar state into the work zone of the shaping body 4.

Figure 4:
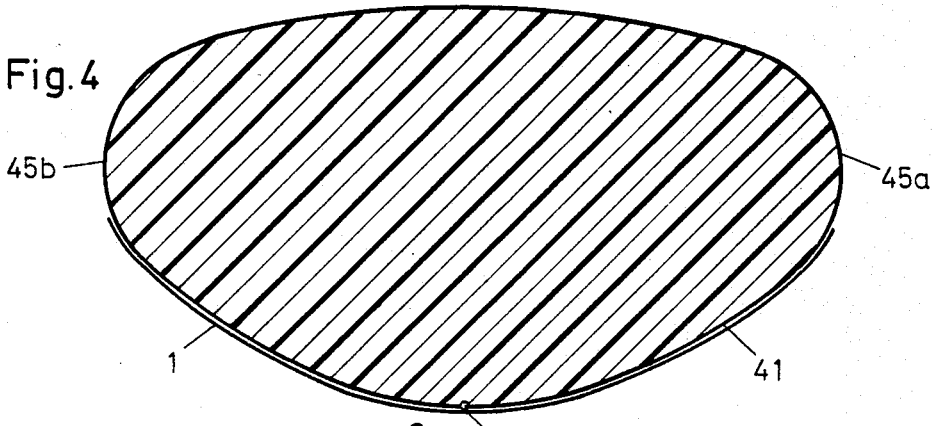
FIG. 4 is a sectional view taken along line IV of FIG. 1.

The shaping body 4 is of symmetrical construction with respect to a longitudinal vertical halving plane which extends perpendicularly to the plane of drawing FIG. 2 and which intersects the underface of the shaping body 4 along line 40, 40*a* (FIGS. 2–5). Since the aluminum foil 1 is supplied to the shaping body 4 in a planar configuration and lies flat against an upstream portion of the shaping body 4 and leaves the shaping body 4 as a sleeve S while again engaging face-to-face a wall of the shaping body 4, a distinction can be made between a first main forming surface 41 and a second main forming surface 42. The line of intersection 40 which is contained in the main forming surface 41 is a straight line until location 43 at which point it has a break to continue as a horizontal straight line designated at 40*a*. The two edge portions 45*a* and 45*b* of the first main forming surface 41 have a smaller slope than the line of intersection 40. As a result, the aluminum foil 1 is transformed from its planar condition shown in FIG. 3 into a concave (dish) shape as shown in FIG. 4.

The second main forming surface 42 starts at location 43. The articles G press the aluminum foil in its mid-portion against the horizontal surface 42, as shown in FIG. 5. In the transitional zone between the first and second main forming surfaces 41 and 42 edges of the shaping body 4 form enlarged ridges 46*a* and 46*b* on which the aluminum foil 1 may glide.

Figure 7:
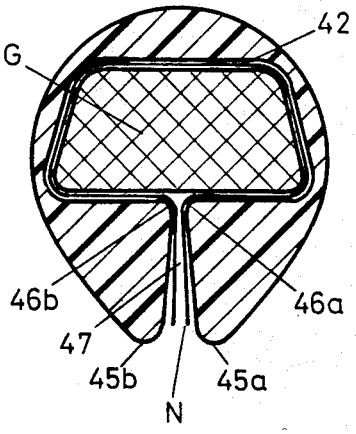
FIG. 7 is a sectional view taken along line VII of FIG. 1.

The two edge portions 45*a* and 45*b* are, shortly after the location defined by the section line III—III in FIG. 1, pulled below the plane of conveyance defined by the guide rails 51 and the rounded ridges 46*a* and 46*b* converge as seen upon comparing FIGS. 5, 6 and 7. In this zone of the shaping body 4 the guide rails 51 taper in an arrow-like manner, since the articles G are supported from that point on in the newly formed sleeve by the ridges 46*a* and 46*b* and portions of the second main forming surface 42. The edge portions 45*a* and 45*b* of the first main forming surface 41 and the remaining portions of this surface form a slot 47 for the edges of the aluminum foil 1 which are then connected to one another by conventional sealing means.

In order to prevent the delicate aluminum foil from tearing, in addition to a uniform conveying speed, an optimum configuration of the shaping body in the folding zone of the foil is required where the foil is transformed into a sleeve S surrounding the articles G.

The shaping body 4 according to the invention shapes the foil in a smooth, uniform manner. The two rounded ridges 46*a* and 46*b* effect a uniform roll-off of the foil on the articles so that the foil, in addition to its gliding motion parallel to the central line, need perform no other sliding motion. As a result, only a single tension force in the conveying direction is exerted on the foil and consequently, no multi-directional forces are generated which would tend to cause tearing of the aluminum foil.

Turning now to FIG. 8, there is illustrated another preferred embodiment of the invention. In order to adapt the shaping body 4' shown in FIG. 8 to articles of different width, the shaping body 4' is preferably made of two separate longitudinal halves 4*a* and 4*b* which are symmetrical with respect to the longitudinal vertical halving plane. The two separate longitudinal halves 4*a* and 4*b* may be secured to one another (for example, by screw connection) such that they are in direct contact with one another, or they may be spaced from one another, in which case an intermediate filler part 4*c* is inserted to fill the longitudinal gap between the body halves 4*a* and 4*b* to thus widen and yet to maintain smooth, continuous surfaces of the shaping body 4'.

In order to further reduce friction between the foil and the shaping body 4' (or 4), spherical glass particles 4*d* of a diameter of 0.2–0.4 mm are embedded close to one another in the shaping body 4 to form a sliding face at least on the first main forming surface 41.

It will be understood that the above description of the present invention is susceptible to various modifications, changes and adaptations, and the same are intended to be comprehended within the meaning and range of equivalents of the appended claims.

What is claimed is:

1. An apparatus for forming a single-fin wrapper sleeve about articles advanced through the apparatus, comprising (a) conveying means including a support on which the articles are placed and which defines a plane of conveyance and means for advancing the articles in a conveying direction in said plane of conveyance;

(b) guiding means for advancing a wrapper foil running through the apparatus;

(c) shaping means for gradually deforming the wrapper foil from a planar configuration to a closed, tubular shape being void of angular edges; said shaping means including a shaping body having a vertical longitudinal halving plane extending parallel to said conveying direction and perpendicularly to said plane of conveyance; said shaping body including (1) a first main forming surface having a planar surface portion situated above said plane of conveyance and inclining theretoward in said conveying direction;

(2) a second main forming surface joining said first main forming surface downstream as viewed in said conveying direction; said second main forming surface having a gradually closing tubular, outwardly concave shape surrounding said support and means defining a longitudinal slot extending underneath said plane of conveyance parallel to said conveying direction and symmetrically with respect to said halving plane, whereby said wrapper foil, upon sliding on said second main forming surface is gradually deformed to said closed tubular shape; and (d) sealing means situated downstream of said shaping body for longitudinally sealing together portions of the foil to form said single-fin wrapper sleeve therefrom; said sealing means forming part of said guiding means.

2. An apparatus as defined in claim 1, wherein said second main forming surface has an upper surface portion extending above said plane of conveyance in an orientation parallel thereto and lateral surface portions adjoining said upper surface portion on both sides of said halving plane; said lateral surface portions gradually converging in said conveying direction, whereby said upper surface portion and said lateral surface portions gradually assume said tubular shape.

3. An apparatus as defined in claim 1, wherein said shaping body further comprises rounded ridges extending along a zone of intersection between said first and second main forming surfaces.

4. An apparatus as defined in claim 3, wherein in a beginning portion of said zone of intersection as viewed in said conveying direction, a transition from said first main forming surface into said second main forming surface has a concave configuration.

5. An apparatus as defined in claim 1, further comprising spherical glass particles of a diameter of 0.2–0.4 mm embedded into said shaping body at least in said first main forming surface thereof.

6. An apparatus as defined in claim 1, wherein said shaping body is longitudinally divided along said halving plane.

7. An apparatus as defined in claim 6, further comprising intermediate parts for insertion between the two halves of the longitudinally divided shaping body.

8. An apparatus as defined in claim 1, wherein said first main forming surface has first and second continuous length portions arranged consecutively as viewed in said conveying direction; said first length portion constituting said planar surface portion; said second length portion having an outwardly convex surface as viewed transversely to said conveying direction; said planar surface changing gradually into said convex surface, whereby said wrapper foil, upon sliding on said first main forming surface, is gradually deformed from a planar shape to an outwardly convex shape; said second main forming surface joining said second length portion of said first main forming surface, whereby said wrapper foil, upon sliding on said second main forming surface is gradually deformed from said outwardly convex shape to said closed tubular shape.

* * * * *